United States Patent [19]

Morz et al.

[11] Patent Number: 4,771,252

[45] Date of Patent: Sep. 13, 1988

[54] HIGH POWER WAVEGUIDE JUNCTION CIRCULATOR HAVING FERRITE SUSPENSION AT THE JUNCTION

[75] Inventors: Günter Morz, Ludwigsburg; Wolfgang Weiser; Sigmund Lenz, both of Aspach; Erich Pivit, Allmersbach i.T. all of Fed. Rep. of Germany

[73] Assignee: ANT Nachrichtentechnik GmbH, Backnang, Fed. Rep. of Germany

[21] Appl. No.: 103,751

[22] Filed: Oct. 2, 1987

[30] Foreign Application Priority Data

Oct. 4, 1986 [DE] Fed. Rep. of Germany ..... 3633909

[51] Int. Cl.[4] ..... H01P 1/39

[52] U.S. Cl. ..... 333/1.1; 333/24.1

[58] Field of Search ..... 333/1.1, 24.1

[56] References Cited

U.S. PATENT DOCUMENTS 4,580,113 4/1986 Pinson ..... 333/24.1 X 4,604,592 8/1986 Pinson ..... 333/24.1

OTHER PUBLICATIONS

F. Okada et al, "Design of a High-Power CW Y-Junction Waveguide Circulator", IEEE Transactions on Microwave Theory and Techniques, vol. MTT-26, No. 5 (May, 1978) pp. 364-369.

F. Okada et al, "High-Power Circulators for Industrial Processing Systems", IEEE Transactions on Magnetics, vol. MAG-17, No. 6 (Nov. 1981) pp. 2957-2960.

*Primary Examiner*—Paul Gensler

*Attorney, Agent, or Firm*—Spencer & Frank

[57] ABSTRACT

A junction circulator for high power, high-frequency use employs cooled ferrite material disposed in the microwave junction zone where it is exposed to a static magnetic field. The cooled ferrite material is provided by a plurality of small ferrite particles which are suspended in a liquid coolant.

6 Claims, 2 Drawing Sheets

HIGH POWER WAVEGUIDE JUNCTION CIRCULATOR HAVING FERRITE SUSPENSION AT THE JUNCTION

CROSS REFERENCE TO RELATED APPLICATIONS

The subject matter of this application is related to that of applicants' copending application entitled "Microwave Junction Circulator," Ser. No. 07/103,727, filed Oct. 2, 1987, the copending application being assigned to the assignee of the present application. The subject matter of this application is also related to that of a copending application entitled "High Power Junction Circulator for High Frequencies" Ser. No. 07/103,728, filed Oct. 2, 1987 the copending application also being assigned to the assignee of the present application.

BACKGROUND OF THE INVENTION

The present invention relates to a junction circulator for high power, high-frequency power use, and more particularly to a junction circulator of the type which includes a cooled ferrite disposed in the microwave junction zone where it is exposed to a static magnetic field.

A microwave circulator is a coupling device having a number of ports for connection to microwave transmission lines, such as waveguides or striplines. Microwave energy entering one port of the circulator is transferred to the next adjacent port in a predetermined direction. A three-port microwave circulator, for example, may be used to transfer energy from a klystron connected to the first port to a particle accelerator connected to the second port. Any microwave energy reflected back to the circulator by the particle accelerator then exits via the third port, so that reflected energy is the diverted from the klystron.

High-power circulators which have cooled ferrite disposed in the waveguide junction zone and which were designed specifically for very high power, high-frequency applications are disclosed by Fumiaki Okada et al in the publications, IEEE Transactions on Microwave Theory and Techniques, Vol. MTT-26, No. 5, May, 1978, pages 364–369, and IEEE Transactions on Magnetics, Vol. MAG-17, No. 6, November, 1981, pages 2957–2960. In the circulators described in these publications, the ferrite structure is composed of a plurality of ferrite discs which are separated from one another by air gaps and which are arranged perpendicularly to the static magnetic field on metal carriers through which a coolant flows.

SUMMARY OF THE INVENTION

It is an object of the present invention to provide a circulator of the above-mentioned type which is suitable, in particular, for operation at very high power and high-frequencies.

This object can be attained, according to the present invention, by dividing the ferrite into small particles which are suspended in a liquid coolant.

By dividing the ferrite into a plurality of small particles, a large cooling surface results, and this makes it possible to dissipate large quantities of heat. Therefore, the circulator can be operated at very high power without the ferrite material being destroyed by thermal stresses.

DESCRIPTION OF THE PREFERRED EMBODIMENT

Figure 1:
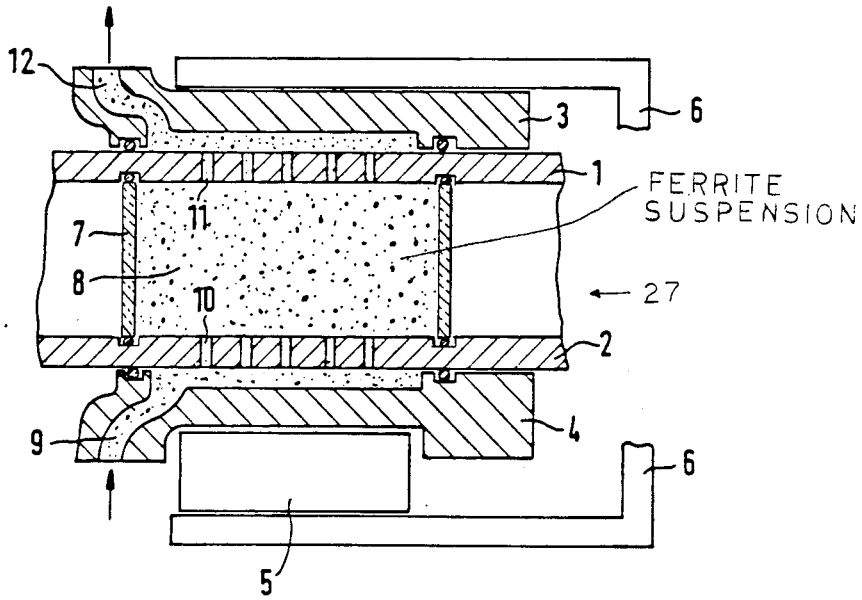
FIG. 1 is a cross sectional view of a ferrite resonator and associated cooling system at the junction zone of a waveguide circulator in accordance with the present invention.
Figure 2:
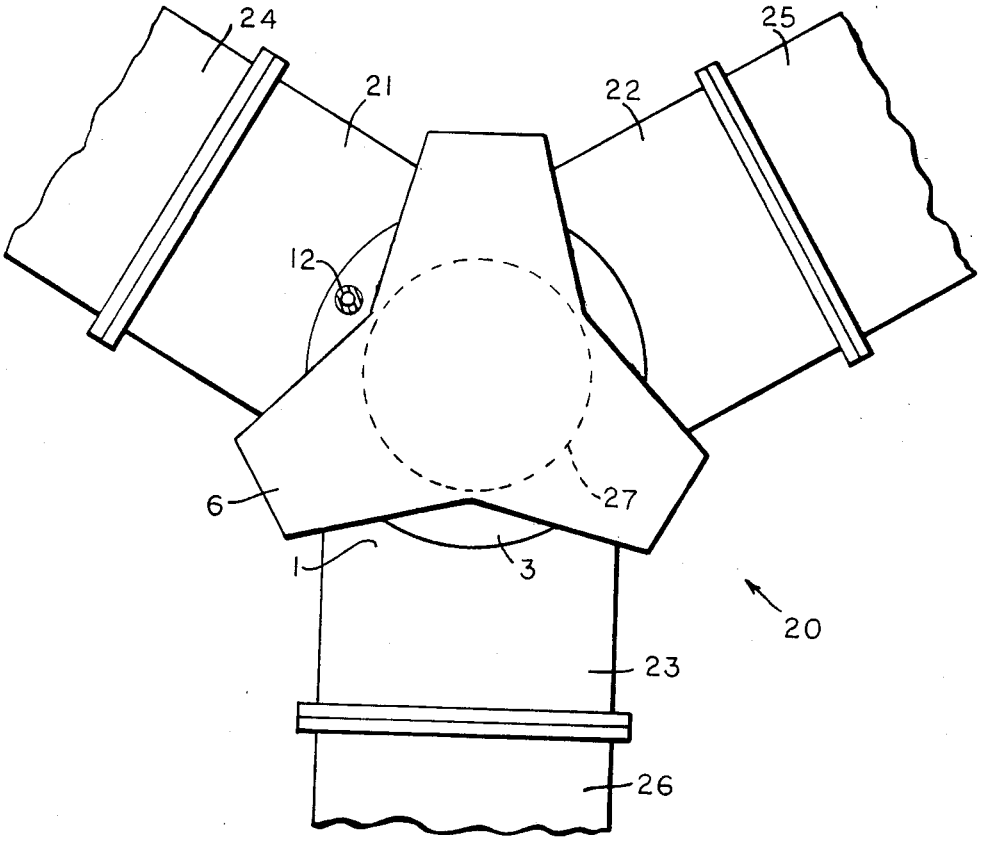
FIG. 2 is a top plan view of a waveguide circulator in accordance with the present invention.

With reference to FIGS. 1 and 2, waveguide circulator 20 has three ports 21, 22, and 23 which are connected to microwave transmission lines such as hollow waveguides 24, 25, and 26. Ports 21–23 communicate with a microwave junction zone within circulator 20, and a ferrite resonator 27 is disposed in the microwave junction zone. FIG. 1 illustrates a sectional view of the junction zone of waveguide circulator 20. This junction zone is penetrated by a static magnetic field which is generated by a magnet system disposed on opposing waveguide walls 1 and 2. The magnet system of the embodiment illustrated here is composed of two pole pieces 3 and 4 disposed above and below the waveguide junction, a permanent magnet 5, and a yoke 6 which forms the magnetic return outside the circulator junction zone and rests, on the one hand, on pole piece 3 and, on the other hand, on permanent magnet 5.

A dielectric container 7 which is sealed against the inner waveguide walls is inserted into the waveguide junction zone and is filled with a suspension 8 of ferrite particles and a liquid coolant. The ferrite particles suspended in the coolant together form an extremely large cooling surface which enhances the dissipation of the heat generated in the ferrite material.

The coolant surrounding the ferrite particles takes over the dissipation of the heat. The suspension 8 of ferrite particles and coolant flows through an influx channel 9 in pole piece 4 and a plurality of holes 10 in waveguide wall 2 into dielectric container 7, and is discharged again through holes 11 in the opposite waveguide wall 1 and a discharge channel 12 in pole piece 3. Thus, suspension 8 is able to circulate through the waveguide junction zone and to transfer the heat it has absorbed, for example to a cooling system (not illustrated) disposed outside circulator 20. In this way, large quantities of heat can be dissipated from the ferrite material disposed in the junction zone when circulator 20 is operated at very high power.

Passage holes 10 and 11 in waveguide walls 1 and 2 have such dimensions that they are impermeable to the high frequency field in circulator 20.

Due to the fact that the ferrite particles suspended in the coolant not only fill the interior of the waveguide but also travel through the waveguide walls 1 and 2 to pole pieces 3 and 4 of the magnet system, the magnetic resistance of the magnetic circuit is reduced. Consequently, only a relatively small magnetic field strength needs be generated, thus permitting the use of a relatively inexpensive magnet system. The reduction of the magnetic resistance between the magnet system and the ferrite particles has the additional advantage that the magnetization of the ferrite particles can be increased to such an extent that circulator 20 can be operated in above resonance mode at frequencies higher than about 2.56 ltr, the limit for above resonance operation up to now. In that case hardly any spin wave losses occur which could produce non-linear effects. An exemplary liquid 8 that may be used to suspend the ferrite particles is liquid paraffin. The ferrite particles can have an arbitrary form with a diameter of about 2 μm.

The present disclosure relates to the subject matter disclosed in Federal Republic of Germany application, Ser. No. P 36 33 909.1 filed Oct. 4th, 1986, the entire disclosure of which is incorporated herein by reference.

It will be understood that the above description of the present invention is susceptible to various modifications, changes and adaptations, and the same are intended to be comprehended within the meaning and range of equivalents of the appended claims.

What is claimed is:

1. A high power, high frequency junction circulator having a plurality of ports for connection to microwave transmission lines, comprising:

junction means, defining a microwave junction zone, for communicating microwaves between the ports and the junction zone;

means for generating a static magnetic field which penetrates the microwave junction zone; and a suspension disposed in the microwave junction zone, the suspension including a liquid coolant and a plurality of small ferrite particles suspended in the liquid coolant.

2. The junction circulator of claim 1, further comprising a dielectric container disposed in the junction zone to receive the suspension.

3. The junction circulator of claim 2, wherein the suspension circulates through the junction zone.

4. The junction circulator of claim 1, wherein the suspension circulates through the junction zone.

5. The junction circulator of claim 1, wherein the transmission lines are hollow waveguides, and wherein the junction means comprises a pair of spaced apart waveguide walls having a resonant cavity between them, the walls having holes through which the suspension flows.

6. The junction circulator of claim 5, further comprising a pair of pole pieces, each pole piece being sealed to a respective waveguide wall on the side thereof that is opposite the resonant cavity, the pole pieces having surfaces that are spaced apart from the waveguide walls, at regions adjacent the holes, to provide channels for passage of the suspension.

* * * * *